US005195918A

United States Patent [19]

Mozes

[11] Patent Number: 5,195,918

[45] Date of Patent: Mar. 23, 1993

[54] CHANGEABLE MOBILE

[76] Inventor: Judith A. Mozes, 4267 W. 63rd St., Cleveland, Ohio 44144

[21] Appl. No.: 785,010

[22] Filed: Oct. 30, 1991

[51] Int. Cl.[5] ..... A63H 33/00

[52] U.S. Cl. ..... 446/227; 446/267; 281/15.1; 281/38; 281/51; 281/45; 40/410; 40/534

[58] Field of Search ..... 446/227, 147, 267, DIG. 1; 283/63.1; 281/45, 15.1, 18, 51, 38; 40/534, 119, 410, 612, 536

[56] References Cited

U.S. PATENT DOCUMENTS

D. 175,089 7/1955 Newmark ..... 446/267 X
2,461,682 2/1949 DeFerrari ..... 446/227 X
4,507,087 3/1985 Stevenson ..... 446/267 X
4,594,072 6/1986 Cowell ..... 446/227
4,932,679 6/1990 Mayer et al. ..... 281/18
4,988,229 1/1991 Ramsey, III ..... 281/45 X

*Primary Examiner*—Mickey Yu
*Attorney, Agent, or Firm*—H. Jay Spiegel

[57] ABSTRACT

Disclosed is a mobile having a plurality of "pages" similar to a book and having designs thereon including beads which are water filled and contain various floating objects. The invention includes a plurality of "pages" which may be turned and fastened to change the design which is visible to a child to keep their interest. Suitable fastening elements are provided allowing the device to be removably fastened, for example, on the back of a vehicle seat facing a child sitting in the rear seat of the vehicle. Fastening elements are also provided between each page for removably holding the pages together so that pages open to view will remain open until manually changed.

4 Claims, 1 Drawing Sheet

CHANGEABLE MOBILE

BACKGROUND OF THE INVENTION

The present invention relates to a changeable mobile. In the prior art, mobiles are known, however, Applicant is unaware of any mobile including all of the features and aspects of the present invention.

Applicant is aware of the following U.S. Pat. Nos.:

3,978,610 to Stubbmann 4,188,745 to Harvey et al.

4,984,380 to Anderson 4,994,075 to Smith et al.

Harvey et al., Anderson and Stubbmann each teach mobiles designed to amuse a child. Smith et al. teach an infant pacifier holder assembly having amusing features for an infant. None of these references teaches a mobile including all of the features and aspects of the present invention.

SUMMARY OF THE INVENTION

The present invention relates to a changeable mobile. The present invention includes the following interrelated objects, aspects and features:

(A) In a first aspect, the inventive mobile in accordance with the teachings of the present invention is made in the form of a book-like structure including a plurality of straps designed to allow the device to be affixed on some diverse object. An example of an object to which the inventive mobile may be releasably affixed is the back surface of a vehicle seat facing a child fastened into an infant seat in the rear of the vehicle.

(B) The inventive mobile includes a plurality of "pages" which may be fastened into view through the use of hook and pile fastening means. Each "page" includes an aesthetic design as well as one or more enlarged beads filled with a liquid and having various objects floating therein.

(C) When it is desired to change the design which is visible to a child, a "page" may be turned over and fastened using hook and pile fastening means or other suitable fastening means to allow two new "page" faces to be indexed into view to amuse the child.

Accordingly, it is a first object of the present invention to provide a changeable mobile.

It is a further object of the present invention to provide such a device including a plurality of "pages", two of which may be selectively indexed into view at any given time.

It is a still further object of the present invention to provide such a device which may be suitably releasably fastened to some diverse object.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 2:
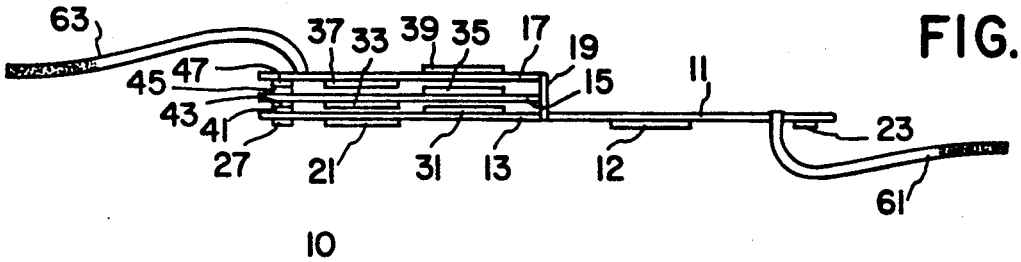
FIG. 2 shows a top view of the present invention.

With reference to the figures, the present invention is generally designated by the reference numeral 10 and is seen to include "pages" 11, 13, 15 and 17. As shown in FIG. 2, the "pages" 13, 15 and 17 are mounted on a flexible binder 19 which may flex as desired when one of the "pages" 13, 15 or 17 is turned over as will be described in greater detail hereinafter.

Figure 1:
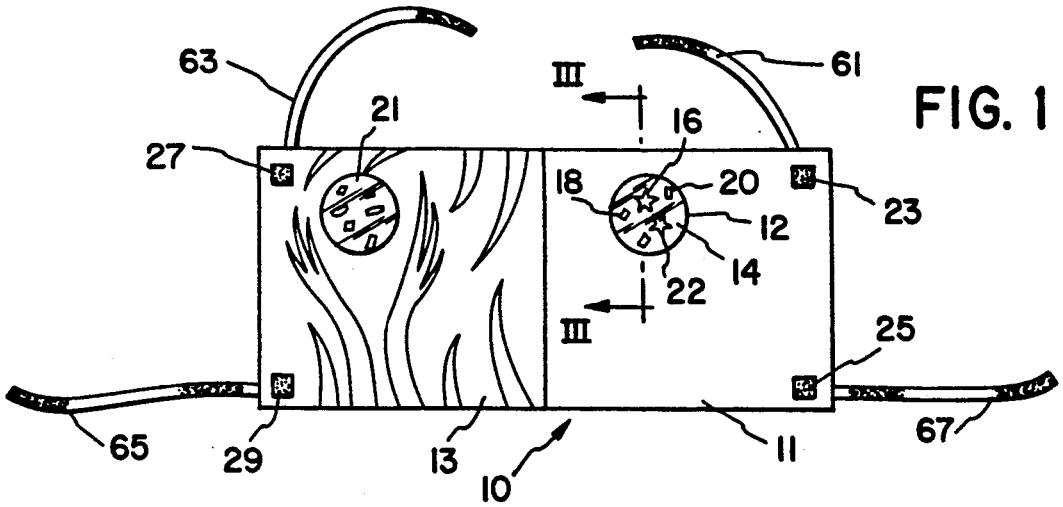
FIG. 1 shows a front view of the present invention.

As seen in FIG. 1, in particular, the "pages", 11 and 13, for example, have aesthetic designs thereon. Thus, the "page" 11 has a bead 12 filled with liquid 14 such as, for example, water as well as a plurality of objects 16, 18, 20 and 22 which have a density allowing them to float within the liquid 14 contained within the bead 12. The bead 21 on the "page" 13 is similar in construction to the bead 12 but has a different mix of objects contained therein as shown.

With further reference to FIGS. 1 and 2, in particular, it is seen that the "page" 11 has hook and pile fastener halves 23, 25 which are designed to intermesh with diverse hook and pile fastening halves 27, 29, respectively, on the "page" 13. Thus, in the view of FIG. 2, when the "page" 13 is rotated counterclockwise so that it overlies the "page" 11, the hook and pile fastening halves 23 and 27 will engage as will the halves 25 and 29 to thereby fasten the "pages" 11 and 13 together thereby bringing into view the rear face of the "page" 13 as well as the front face of the "page" 15.

As seen in FIG. 2, the rear face of the "page" 13 has a bead 31 similar in structure to the bead 21 thereon. The "page" 15 has a front facing bead 33 and a rear facing bead 35 which is indexed into view when the "page" 15 is folded over the "page" 13 with the "page" 13 folded over the "page" 11. Similarly, the "page" 17 has a front facing bead 37 and a rear facing bead 39.

Also shown in FIG. 2 are facing and intermeshing hook and pile fastening halves 41, 43 and 45, 47 which operate in the same manner as the halves 23, 27 and 25, 29, respectively.

Figure 3:
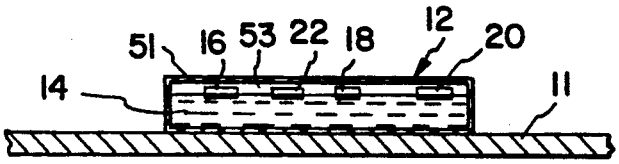
FIG. 3 shows a cross-sectional view along the line III—III of FIG. 1.

With reference to FIG. 3, it is seen that the bead 12, which is typical of the beads 21, 31, 33, 35, 37 and 39, includes an outer housing 51 which is fluid tight and defines an internal chamber 53 having the liquid 14 therein, preferably water, as well as the objects 16, 18, 20 and 22 floating on the surface thereof. The bead 12 is suitably fastened to the front face of the "page" 11 using any suitable means such as, stitching, gluing or other adhesive, etc.

With reference back to FIG. 1, the aesthetic design on the front face of the "page" 13 may be applied through any suitable means such as dyeing, silk screening, printing, glueing or any other suitable method and/or means.

With further reference to FIG. 1, it is seen that the inventive device 10 has a plurality of fastening straps 61, 63, 65 and 67 attached thereto. These straps may include hook and pile fastening means, buttons, snaps or other suitable fasteners to allow them to be interconnected to one another or back upon themselves to allow suitable releasable fastening of the device 10 in any desired location. In this regard, particular reference is made to FIG. 4 wherein a front seat 1 of a vehicle is seen to include a bottom 2, a back 3, hinges of which the hinge 4 is shown as well as a head rest 5 supported on a post 6. In the example shown in FIG. 4, the straps 61 and 63 are attached together in front of the support post 6 of the head rest 5 of the seat 1 to fasten the top of the device 10 in place. The strap 65 is wound around the hinge (not shown) and fastened upon itself as shown. The strap 67 is fastened around the hinge 4 and fastened about itself as shown. Again, any suitable fastening means may be employed to either interconnect separate straps or connect a strap to itself in a looped configuration. Of course, the straps and their manner of attachment or interconnection are considered to be merely examples of the various ways in which the inventive device 10 may be suitably releasably fastened on a fixed object.

Figure 4:
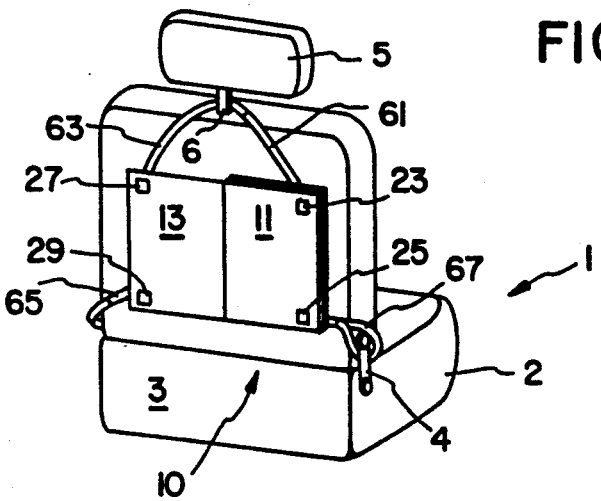
FIG. 4 shows a rear perspective view of a vehicle seat with the present invention releasably attached thereto.

Through the use of the present invention, when fastened, for example, as shown in FIG. 4, two "pages", for example, 11, 13 will be visible to a child and as the vehicle moves the objects within the beads, for example, 12, 21, will move about providing an aesthetic, pleasing design for a child in conjunction with the design of the rest of the designs on the faces which are visible to the child.

When it is desired to change the design which is visible to the child, the "pages" may be folded over and fastened as described above to provide a child with a new view.

As such, an invention has been disclosed in terms of a preferred embodiment thereof which fulfills each and every one of the objects of the present invention as set forth hereinabove and provides a new and useful changeable mobile of great novelty an utility. Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A changeable mobile, comprising:

a) a first page-like structure having an aesthetic design on one face thereof;

b) a plurality of second page-like structures each having first and second faces and an aesthetic design on each of said first and second faces, said second page-like structures being hingedly connected to said first page-like structure;

c) said mobile having a first configuration with said first page-like structure laterally adjacent one of said second page-like structures with a first face thereof facing in a same direction as said one face, said one of said second page-like structures being pivotable to a position overlying said first page-like structure with a second face thereof exposed whereby a first face of another of said second page-like structures is thereby exposed to view;

d) attachment means for attaching said mobile on a fixed object; and e) each said aesthetic design including a container filled with liquid and a plurality of objects floating in said liquid.

2. The invention of claim 1, wherein each of said page-like structures includes fastening means allowing releasable fastening in desired configurations, said fastening means including a first fastener between said one face of said first page-like structure and said first face of said one of said second page-like structures, and a second fastener between said second face of said one of said second page-like structures and a first face of an adjacent further second page-like structure.

3. The invention of claim 1, wherein said attachment means comprises a plurality of straps.

4. The invention of claim 3, wherein each of said straps has hook and pile fastening means thereon.

* * * * *